US006887835B1

(12) United States Patent
Migdal et al.

(10) Patent No.: US 6,887,835 B1
(45) Date of Patent: May 3, 2005

(54) SILANE ADDITIVES FOR LUBRICANTS AND FUELS

(75) Inventors: Cyril A. Migdal, Pleasant Valley, NY (US); Robert G. Rowland, Woodbridge, CT (US); David J. Sikora, Middlebury, CT (US); Frederick D. Osterholtz, Pleasantville, NY (US)

(73) Assignee: Crompton Corporation, Middlebury, CT (US)

( * ) Notice: Subject to any disclaimer, the term of this patent is extended or adjusted under 35 U.S.C. 154(b) by 56 days.

(21) Appl. No.: 10/404,176

(22) Filed: Mar. 31, 2003

Related U.S. Application Data

(60) Provisional application No. 60/394,265, filed on Jul. 9, 2002.

(51) Int. Cl.[7] ..... C10M 139/04; C10L 1/28

(52) U.S. Cl. ..... 508/204; 508/205; 508/206; 508/207; 508/208; 508/215; 508/371; 44/320

(58) Field of Search ..... 508/207, 204; 44/320

(56) References Cited

U.S. PATENT DOCUMENTS

| | | | | |
|---|---|---|---|---|
| 2,947,772 A | | 8/1960 | Eynon et al. | |
| 2,995,590 A | | 8/1961 | Peeler et al. | |
| 3,293,181 A | | 12/1966 | Stuan | |
| 3,329,698 A | | 7/1967 | Popoff | |
| 3,396,109 A | | 8/1968 | Butor et al. | |
| 3,397,145 A | | 8/1968 | Cyba | |
| 3,442,804 A | | 5/1969 | Le Sier et al. | |
| 3,637,499 A | | 1/1972 | Pollak | |
| 3,694,480 A | * | 9/1972 | Omietanski | 556/440 |
| 4,374,742 A | * | 2/1983 | Evans et al. | 508/204 |
| 4,541,838 A | * | 9/1985 | Zaweski et al. | 44/320 |
| 4,572,791 A | * | 2/1986 | Onopchenko et al. | 508/207 |
| 4,788,312 A | * | 11/1988 | Paciorek et al. | 556/435 |
| 4,818,251 A | * | 4/1989 | Easton et al. | 44/320 |
| 4,824,982 A | * | 4/1989 | Vahlensieck et al. | 556/451 |
| 4,950,779 A | | 8/1990 | Wengrovius et al. | |
| 4,973,724 A | * | 11/1990 | Nelson | 556/465 |
| 5,084,195 A | | 1/1992 | Camenzind et al. | |
| 5,120,458 A | * | 6/1992 | Nelson et al. | 508/207 |
| 5,300,243 A | | 4/1994 | Camenzind et al. | |
| 5,466,848 A | | 11/1995 | Childress | |
| 5,489,701 A | | 2/1996 | Childress et al. | |
| 5,498,809 A | | 3/1996 | Emert et al. | |
| 5,512,190 A | | 4/1996 | Anderson et al. | |
| 5,514,189 A | | 5/1996 | Farng et al. | |
| 5,596,116 A | | 1/1997 | Childress et al. | |
| 6,127,468 A | | 10/2000 | Cruse et al. | |
| 6,140,445 A | | 10/2000 | Su et al. | |
| 6,268,315 B1 | | 7/2001 | Baca et al. | |
| 6,359,046 B1 | | 3/2002 | Cruse | |

FOREIGN PATENT DOCUMENTS

| | | |
|---|---|---|
| GB | 707906 | 4/1954 |
| GB | 760097 | 10/1956 |
| GB | 791609 | 3/1958 |
| GB | 1441335 | 6/1976 |
| JP | 8-337788 | 12/1996 |
| RU | 245955 | 11/1969 |
| RU | 771147 | 10/1980 |
| WO | WO9966009 | 12/1999 |

OTHER PUBLICATIONS

K Kato "Wear Mechanisms" appearing in Plenary & Invited Papers from the Best World Tribology Congress New Directions in Tribology, published by Mechanical Engineering Publications for last of Mech Engineersk, Bury St Edmunds, K K (1997).

Edwin P Plueddemann Silane Coupling Agents 2$^{nd}$ Ed Plenum Press. New York, (1991) (1982).

H. Boyington Friction, Wear and the Role of Addatives mother Control appearing in Chemistry & Technology of Lubricants 2 14 (1997).

* cited by examiner

*Primary Examiner*—Ellen M. McAvoy
(74) *Attorney, Agent, or Firm*—Michael P. Dilworth

(57) ABSTRACT

Lubricants, especially lubricating oils, and fuels, especially hydrocarbon fuels, contain a class of anti-wear, anti-fatigue, and extreme pressure additives that are derived from silanes. The additives can be used as either partial or complete replacements for zinc dialkyldithiophosphates currently used in lubricants and fuels.

9 Claims, No Drawings

SILANE ADDITIVES FOR LUBRICANTS AND FUELS

This application claims priority to U.S. Provisional Application No. 60/394,265, filed Jul. 9, 2002.

BACKGROUND OF THE INVENTION

1. Field of the Invention

This invention is related to lubricants, especially lubricating oils, and fuels, especially hydrocarbon fuels, and, more particularly, to a class of anti-wear, anti-fatigue, and extreme pressure additives that are derived from silanes for such lubricants and fuels.

2. Description of Related Art

In developing lubricating oils, there have been many attempts to provide additives that impart anti-fatigue, anti-wear, and extreme pressure properties thereto. Zinc dialkyldithiophosphates (ZDDP) have been used in formulated oils as anti-wear additives for more than 50 years. However, zinc dialkyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the anti-wear properties of the lubricating oil.

In view of the aforementioned shortcomings of the known zinc and phosphorus-containing additives, efforts have been made to provide lubricating oil additives that contain neither zinc nor phosphorus or, at least, contain them in substantially reduced amounts. Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides anti-wear properties to a lubricating oil. The additive is the reaction product of 2,5-dimercapto-1,3,4-thiadiazole and a mixture of unsaturated mono-, di-, and triglycerides. Also disclosed is a lubricating oil additive with anti-wear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective anti-wear/antioxidant additives for lubricants and fuels.

U.S. Pat. Nos. 5,084,195 and 5,300,243 disclose N-acyl-thiourethane thioureas as anti-wear additives specified for lubricants or hydraulic fluids.

U.S. application Ser. No. 09/872,722, filed Jun. 1, 2001, discloses a composition comprising:

(A) a lubricant, and

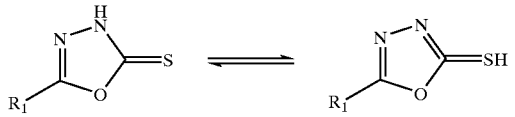

(B) at least one 5-alkyl-2-mercapto-1,3,4-oxadiazole compound of the formula: wherein $R_1$ is a hydrocarbyl or functionalized hydrocarbyl of from 1 to 30 carbon atoms.

Japanese patent publication 8-337788 (Dec. 24, 1996) claims additives consisting of silane compounds., e.g., $R_1Si(OR)_3$, $(R_1)_2Si(OR)_2$, and $(R_1)_3SiOR$(R=H, $C_{1-18}$ alkyl, $C_{2-18}$ alkenyl, $C_{6-18}$ aryl; $R_1$=$C_{6-50}$ alkyl, alkenyl, aryl; the alkyl group in $R_1$ may contain N, O, or S or be substituted with OH, $CO_2H$, alkoxycarbonyl, alkenoxycarbonyl, or aryloxycarbonyl). The lubricating oil compounds contain (1) 0.05–10 wt. % the silane additives or (2) the silane additives, metal detergents, and optionally extreme-pressure agents and ashless dispersants. The additives are said to decrease friction of engine oils and improve piston detergency.

Russian patent 245955 (Jun. 11, 1969) discloses that the antifriction and antiwear properties of mineral oil lubricants are increased by addition of organosilanes. To improve the properties of the lubricants, trialkoxy-organosilanes with various functional groups of the formula $(RO)_3SiR'X$ are used, where RO is an alkoxy group, R' is an alkyl, alkylene, or aryl radical, and X is a functional group, such as $NH_2$, $CO_2H$, COH, OH, or CN.

The disclosures of the foregoing references are incorporated herein by reference in their entirety.

SUMMARY OF THE INVENTION

The present invention is directed to additives that can be used as either partial or complete replacements for the zinc dialkyldithiophosphates currently used. They can also be used in combination with other additives typically found in motor oils, as well as other ashless anti-wear additives. The typical additives found in motor oils include dispersants, detergents, anti-wear agents, extreme pressure agents, rust inhibitors, antioxidants, antifoamants, friction modifiers, Viscosity Index improvers, metal passivators, and pour point depressants.

The compounds employed in the practice of this invention are silanes that are useful as non-phosphorus-containing, anti-fatigue, anti-wear, extreme pressure additives for fuels and lubricating oils. The terms "anti-fatigue" and "anti-wear" are well known terms of art in the petroleum additives field. An excellent discussion of the mechanisms of fatigue and wear, and the role of additives in controlling fatigue and wear, can be found in Chemistry and Technology of Lubricants (Mortier, R. M., Orszulik, ST., Eds.), Second Edition, Chapter 12:"Friction, wear, and the role of additives in their control" C. H. Bovington (1992), the contents of which are incorporated by reference herein.

The present invention also relates to lubricating oil compositions comprising a lubricating oil and a functional property-improving amount of at least one silane.

It is an object of the present invention to provide a new application for silanes useful either alone or in combination with other lubricant additives. The silanes in combination with zinc dialkyl dithiophosphate, zinc diaryl dithiophosphate, and/or zinc alkylaryl dithiophosphate are an improvement over the prior art.

The additives of the present invention are especially useful as components in many different lubricating oil compositions. The additives can be included in a variety of oils with lubricating viscosity including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions.

The class of anti-fatigue, anti-wear, and extreme pressure additives are organosilanes having the following generic formula (I):

$$[(R^1)_{3-a}(R^2O)_aSi]_rA \quad (I)$$

wherein $R^1$ is selected from the group consisting of saturated and unsaturated hydrocarbyl and chain-substituted saturated and unsaturated hydrocarbyl;

$R^2$ is selected from the group consisting of hydrogen, saturated and unsaturated hydrocarbyl and chain-substituted saturated and unsaturated hydrocarbyl;

a is an integer from 1 to 3, and

A is a group of valence r, r being an integer greater than or equal to 1, selected from the group consisting of saturated and unsaturated, linear, branched, or cyclic hydrocarbyl groups, an oxygen atom, or a linear, branched, or cyclic siloxane or polysiloxane group, each of which, except for an oxygen atom, optionally comprises substituents having oxygen, nitrogen, sulfur, or halogen heteroatoms.

More particularly, the present invention is directed to a composition comprising:

(A) a lubricant or a hydrocarbon fuel, and (B) at least one silane of formula (I):

$$[(R^1)_{3-a}(R^2O)_aSi]_rA \quad (I)$$

wherein $R^1$ is selected from the group consisting of saturated and unsaturated hydrocarbyl and is saturated and unsaturated chain-substituted hydrocarbyl;

$R^2$ is selected from the group consisting of hydrogen, saturated and unsaturated hydrocarbyl and saturated and unsaturated chain-substituted hydrocarbyl;

a is an integer from 1 to 3; and

A is a group of valence r, r being an integer greater than or equal to 1, selected from the group consisting of saturated and unsaturated, linear, branched, or cyclic hydrocarbyl groups, an oxygen atom, or a linear, branched, or cyclic siloxane or polysiloxane group, each of which, except for an oxygen atom, optionally comprises substituents having oxygen, nitrogen, sulfur, or halogen heteroatoms.

The silane is present in the compositions of the present invention in a concentration in the range of from about 0.01 to about 10 wt %.

DESCRIPTION OF THE PREFERRED EMBODIMENTS

As stated above, the class of anti-fatigue, anti-wear, and extreme pressure additives can have the following generic formula (I):

$$[(R^1)_{3-a}(R^2O)_aSi]_rA \quad (I)$$

wherein $R^1$ is selected from the group consisting of saturated and unsaturated hydrocarbyl and chain-substituted saturated and unsaturated hydrocarbyl;

$R^2$ is selected from the group consisting of hydrogen, saturated and unsaturated hydrocarbyl and chain-substituted saturated and unsaturated hydrocarbyl;

a is an integer from 1 to 3, and

A is a group of valence r, r being an integer greater than or equal to 1, selected from the group consisting of saturated and unsaturated, linear, branched, or cyclic hydrocarbyl groups, an oxygen atom, or a linear, branched, or cyclic siloxane or polysiloxane group, each of which, except for an oxygen atom, optionally comprises substituents having oxygen, nitrogen, sulfur, or halogen heteroatoms.

A preferred class of anti-fatigue, anti-wear, and extreme pressure additives are those corresponding to formula (I) wherein r is 1, as well as oligomers thereof formed by hydrolysis, hydrosilylation or polymerization. If r is 1, A is preferably a saturated or unsaturated, linear, branched, or cyclic hydrocarbyl group, optionally containing an N-bonded group, e.g., amine, imine, carbamate, thiocarbamate, isocyanate, isocyanurate, and the like; an O-bonded group, e.g., ester, ether, polyether group, and the like; an S-bonded group, e.g., mercaptan, blocked mercaptan, thioether, thioester, sulfide, polysulfide, and the like; or a C-bonded group, e.g., carbonyl or a carbonyl derivative, such as acetal, ketal, thioketal and the like, nitrile, cyanate, thiocyanate, and the like. Preferably, where r is 1, A is selected from the group linear or branched hydrocarbyl radicals containing 1 to 24 carbon atoms, including methyl, ethyl, propyl, butyl, hexyl, octyl, nonyl, methylethyl, methylpropyl, methylbutyl, decyl, dodecyl, diethylenylbenzyl, and the like. More preferably, where r is 1, A is selected from linear or branched hydrocarbyl radicals from 2 to 18 carbon atoms, and most preferably, from 4 to 12 carbon atoms.

Another preferred class of anti-fatigue, anti-wear, and extreme pressure additives are those corresponding to formula (I) wherein r is 2. Such additives correspond to the general formula (II):

$$(R^1{}_{3-a})(R^2O)_a\text{—Si—B—Si—}(OR^2)_a(R^1{}_{3-a}) \quad (II)$$

wherein $R^1$, $R^2$, and a are as defined above for formula (I) and B is a divalent group selected from the group consisting of a saturated or unsaturated, linear, branched, or cyclic hydrocarbyl group, an oxygen atom, a linear, branched, or cyclic siloxane or polysiloxane group, each of which, except for an oxygen atom, optionally comprises substituents having oxygen, nitrogen, sulfur, halogen heteroatoms, $(CR^4R^5)_b(CR^6R^7)_c$, $C_bH_{2b}$—X'—$C_cH_{2c}$, $(CR^4R^5)_p$—X'—$(CR^6R^7)_q$, and cyclo $C_sH_q(C_bH_{2b})_t$, wherein $R^4$, $R^5$, $R^6$, and $R^7$ are the same or different and are independently selected from the group consisting of hydrogen, saturated and unsaturated hydrocarbyl, and saturated and unsaturated chain-substituted hydrocarbyl, b, c, p, and q are integers independently selected from 1 to 18, s in an integer greater than 2, t is an integer greater than 1, a is an integer from 1 to 3 and X' is selected from the group consisting of

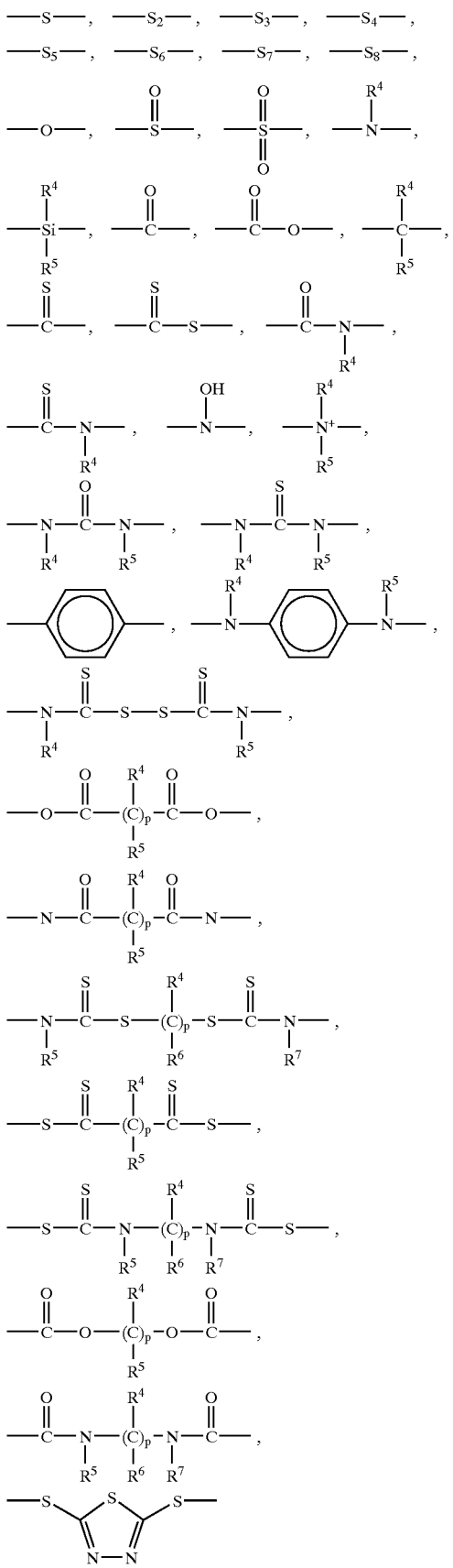

and mixtures thereof, wherein $R^4$, $R^5$, $R^6$ and $R^7$ are independently the same or different and are as defined above. More preferably, where r is 2, A is a dial kylene polysulfide unit, $CH_2CH_2CH_2S_uCH_2CH_2CH_2$, where u is an integer of 1 to 10, most preferably an average value of 2 or 4.

In general formulas (I) and (II), $R^1$ and $R^2$ are preferably independently selected from the group consisting of $C_1$-$C_{18}$ alkyl, aryl, alkaryl, alkoxyaryl, alkoxyalkyl, and alkylthioalkyl.

More preferably, $R^1$ and $R^2$ are independently selected from the group consisting of $C_1$-$C_8$ linear, branched, or cyclic alkyl, such as methyl, ethyl, propyl, butyl, pentyl, hexyl, heptyl, octyl, isopropyl, isobutyl, isopentyl, isoheptyl, isooctyl, sec-butyl, 1-methylbutyl, 1-ethylpropyl, cyclopropyl, cyclobutyl, cyclopentyl, cyclohexyl, cyclooctyl, and the like; aryl, alkaryl, alkoxyaryl, or alkoxyalkyl, such as phenyl, tolyl, xylyl, benzyl, methoxyphenyl, methoxymethyl, methoxyethyl, ethoxymethyl, ethoxyethyl, and the like; and ethylthiomethyl, methythioethyl, and the like.

Even more preferably, $R^1$ and $R^2$ are independently selected from the group consisting of methyl, ethyl, propyl, butyl, pentyl, isopropyl, isobutyl, isopentyl, sec-butyl, 1-methylbutyl, 1-ethylpropyl, cyclopentyl, cyclohexyl, phenyl, tolyl, benzyl, and methoxyethyl.

Most preferably, $R^1$ and $R^2$ are independently selected from the group consisting of methyl and ethyl.

Preferably, $R^4$, $R^5$, $R^6$ and $R^7$ are independently selected from the group consisting of hydrogen, $C_1$–$C_{18}$ alkyl, aryl, alkaryl, alkoxyaryl, alkoxyalkyl, and alkylthioalkyl.

More preferably $R^4$, $R^5$, $R^6$ and $R^7$ are independently selected from the group consisting of hydrogen, $C_1$–$C_8$ linear, branched, or cyclic alkyl, such as methyl, ethyl, propyl, butyl, pentyl, hexyl, heptyl, octyl, isopropyl, isobutyl, isopentyl, isoheptyl, isooctyl, sec-butyl, 1-methylbutyl, 1-ethylpropyl, cyclopropyl, cyclobutyl, cyclopentyl, cyclohexyl, cyclooctyl, and the like; aryl, alkaryl, alkoxyaryl, or alkoxyalkyl, such as phenyl, tolyl, xylyl, benzyl, methoxyphenyl, methoxymethyl, methoxyethyl, ethoxymethyl, ethoxyethyl, and the like; and ethylthiomethyl, methythioethyl, and the like.

Still more preferably, $R^4$, $R^5$, $R^6$ and $R^7$ are independently selected from the group consisting of hydrogen, methyl, ethyl, propyl, butyl, pentyl, isopropyl, isobutyl, isopentyl, sec-butyl, 1-methylbutyl, 1-ethylpropyl, cyclopentyl, cyclohexyl, phenyl, tolyl, benzyl, and methoxyethyl.

$R^4$, $R^5$, $R^6$ and $R^7$ are most preferably all hydrogen.

Also preferred are polyvalent versions of A, such as isomers of triethylenylcyclohexane, $(CH_2CH_2)_3C_6H_9$, where r is 3.

The use of the silanes of this invention can improve the anti-fatigue, anti-wear, and extreme pressure properties of a lubricant.

Some of these compounds are manufactured by the OSi Specialties business group of Crompton Corporation. Some specific preferred examples include bis(3-triethoxysilyl-1 propyl) tetrasulfide; bis(3-triethoxysilyl-1-propyl) disulfide; 1,2-bis-(triethoxysilyl) ethane; 1,4-bis-(triethoxysilyl) butane; 1,6-bis-(triethoxsilyl) hexane octyl triethoxysilane; and 1,2,4-tris-(2-trimethoxysilylethyl)cyclohexane.

Other depictions of silanes with two Si containing moities are given in U.S. Pat. Nos. 6,127,468 and 6,359,046, incorporated by reference herein.

Oligomeric silane structures and their preparation are described in U.S. Pat. Nos. 4,950,779 and 6,140,445, incorporated by reference herein.

References for the preparation of monomeric silanes are described in "Chemistry and Technology of Silicones", W. Noll, 1968, Academic Press, New York or "Silane Coupling Agents, Second Ed.", E. Pleuddemann, 1991, Plenum Publishing, New York, incorporated by reference herein.

Processes to make sulfur silanes can be found in U.S. Pat. Nos. 5,596,116 and 5,489,701, which, along with the references included therein and the above references, are incorporated herein by reference.

Specifically, the production of a preferred compound, 3,3'-bis (triethoxysilylpropyl) tetrasulfide, is described in U.S. Pat. Nos. 5,466,848 and 5,489,701 incorporated by reference herein. It should be noted that the gas chromatography (GC) assignments of trisulfide and tetrasulfide in these patents are incorrect and should respectively be disulfide and trisulfide. Those of ordinary skill in the art recognize the higher polysulfide silanes are decomposed by the GC conditions.

Processes to make the bis-(triethoxysilyl) alkanes utilize the reaction of acetylene or dialkenes (e.g. 1,6-hexadiene) with silane reagents. Silane reagents may include formulas such as $$HSi(R^1)_{3-a}(OR^2)_a$$

in which $R^1$, $R^2$, and a are as defined before. The addition of silanes across multiple bonds occurs in the presence of catalysts, typically complexes of VIII B group elements (e.g. Co, Ni, Pd, Ru, and Pt).

The silane additives of this invention can be used as either a partial or complete replacement for the zinc dialkyldithiophosphates currently used. They can also be used in combination with other additives typically found in lubricating oils, as well as with other antiwear additives. The additives typically found in lubricating oils are, for example, dispersants, detergents, corrosion/rust inhibitors, antioxidants, anti-wear agents, anti-foamants, friction modifiers, seal swell agents, demulsifiers, VI improvers, pour point depressants, and the like. See, for example, U.S. Pat. No. 5,498,909 for a description of useful lubricating oil composition additives, the disclosure of which is incorporated herein by reference in its entirety.

Examples of dispersants include polyisobutylene succinimides, polyisobutylene succinate esters, Mannich Base ashless dispersants, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants include alkylated diphenylamines, N-alkylated phenylenediamines, phenyl-a-naphthylamine, alkylated phenyl-a-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like. The following are exemplary of such additives and are commercially available from Crompton Corporation: Naugalube® 438, Naugalube 438L, Naugalube 640, Naugalube 635, Naugalube 680, Naugalube AMS, Naugalube APAN, Naugard PANA, Naugalube TMQ, Naugalube 531, Naugalube 431, Naugard® BHT, Naugalube 403, and Naugalube 420, among others.

Examples of anti-wear additives that can be used in combination with the additives of the present invention include organo-borates, organo-phosphites, organo-phosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryldithiophosphate esters, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; and from Ciba Corporation: Irgalube 353.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialklidithiocarbamates, non-sulfur molybdenum compounds and the like. The following are exemplary of molybdenum additives and are commercially available from R. T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K. K.: SAKURA-LUBE 100, SAKURA-LUBE 165, SAKURA-LUBE 300, SAKUPA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others.

An example of an anti-foamant is polysiloxane, and the like. Examples of rust inhibitors are polyoxyalkylene polyol, benzotriazole derivatives, and the like. Examples of VI improvers include olefin copolymers and dispersant olefin copolymers, and the like. An example of a pour point depressant is polymethacrylate, and the like.

As noted above, suitable anti-wear compounds include dihydrocarbyl dithiophosphates. Preferably, the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms. The acids from which the dihydrocarbyl dithiophosphates can be derived can be illustrated by acids of the formula:

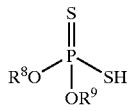

wherein $R^8$ and $R^9$ are the same or different and are alkyl, cycloalkyl, aralkyl, alkaryl, or substituted substantially hydrocarbyl radical derivatives of any of the above groups, and wherein the $R^5$ and $R^9$ groups in the acid each have, on average, at least 3 carbon atoms. By "substantially hydrocarbyl" is meant radicals containing substituent groups, e.g., 1 to 4 substituent groups per radical moiety, such as ether, ester, thio, nitro, or halogen, that do not materially affect the hydrocarbon character of the radical.

Specific examples of suitable $R^8$ and $R^9$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-dipentylphenyl, octylphenyl, polyisobutene-(molecular weight 350)-substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl and xenyl radicals. Alkyl radicals having from about 3 to about 30 carbon atoms and aryl radicals having from about 6 to about 30 carbon atoms are preferred. Particularly preferred $R^8$ and $R^9$ radicals are alkyl of from 4 to 18 carbon atoms.

The phosphorodithioic acids are readily obtainable by the reaction of phosphorus pentasulfide and an alcohol or phenol. The reaction involves mixing at a temperature of about 20° C. to 200° C., 4 moles of the alcohol or phenol with one mole of phosphorus pentasulfide. Hydrogen sulfide is liberated as the reaction takes place. Mixtures of alcohols, phenols, or both can be employed, e.g., mixtures of $C_3$ to $C_{30}$ alcohols, $C_6$ to $C_{30}$ aromatic alcohols, etc.

The metals useful to make the phosphate salts include Group I metals, Group II metals, aluminum, lead, tin, molybdenum, manganese, cobalt, and nickel. Zinc is the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, and nickel carbonate.

In some instances, the incorporation of certain ingredients, particularly carboxylic acids or metal carboxylates, such as, small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109; and 3,442,804; the disclosures of which are hereby incorporated by reference. Also useful as anti-wear additives are amine derivatives of dithiophosphoric acid compounds, such as are described in U.S. Pat. No. 3,637,499, the disclosure of which is hereby incorporated by reference in its entirety.

The zinc salts are most commonly used as anti-wear additives in lubricating oil in amounts of 0.1 to 10, preferably 0.2 to 2 wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols can be used, including mixtures of primary and secondary alcohols, secondary generally for imparting improved antiwear properties and primary for thermal stability. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil soluble salts of dihydrocarbyl esters of dithiophosphoric acids and can be represented by the following formula:

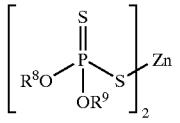

wherein $R^8$ and $R^9$ are as described in connection with the previous formula.

Lubricant Compositions

Compositions, when they contain these additives, are typically blended into a base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.1–10 | 0.1–5 |
| Lube Oil Flow Improver | 0.01–2 | 0.01–1.5 |
| Detergent/Rust Inhibitor | 0.01–6 | 0.01–3 |
| Pour Point Depressant | 0.01–1.5 | 0.01–0.5 |
| Anti-foaming Agents | 0.001–0.1 | 0.001–0.01 |
| Anti-wear Agents | 0.001–5 | 0.001–1.5 |
| Seal Swell Agents | 0.1–8 | 0.1–4 |
| Friction Modifiers | 0.01–3 | 0.01–1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (Al) content of the additive, and/or upon the total weight of any additive-package, or formulation, which will be the sum of the Al weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Other esters useful as synthetic oils include those made from copolymers of $\alpha$-olefins and dicarboylic acids which are esterified with short or medium chain length alcohols. The following are exemplary of such additives and are commercially available from Akzo Nobel Chemicals SpA: Ketjenlubes 115, 135, 165, 1300, 2300, 2700, 305, 445, 502, 522, and 6300, among others.

Silicon-based oils, such as the polyalkyl-, polyaryl-, polyalkoxy-, or polyaryloxy-siloxane oils, silicate oils and silahydrocarbons, comprise another useful class of synthetic lubricating oils. Other synthetic lubricating oils include liquid esters of phosphorus-containing acids, polymeric tetrahydrofurans, poly a-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Anti-Wear Four-Ball Testing

The anti-wear properties of the silanes in a fully formulated lubricating oil were determined in the Four-Ball Wear Test under the ASTM D 4172 test conditions. The testing for these examples was done on a Falex Variable Drive Four-Ball Wear Test Machine. Four balls are arranged in an equilateral tetrahedron. The lower three balls are clamped securely in a test cup filled with lubricant and the upper ball is held by a chuck that is motor-driven. The upper ball rotates against the fixed lower balls. Load is applied in an upward direction through a weight/lever arm system. Loading is through a continuously variable pneumatic loading system. Heaters allow operation at elevated oil temperatures. The three stationary steel balls are immersed in 10 milliliters of sample to be tested, and the fourth steel ball is rotated on top of the three stationary balls in "point-to-point contact." The machine is operated for one hour at 75° C. with a load of 40 kilograms and a rotational speed of 1,200 revolutions per minute. The fully formulated lubricating oil contained all the additives typically found in a motor oil (with different anti-wear agents as noted in TABLE 2) as well as 0.5 wt. % cumene hydroperoxide to help simulate the environment within a running engine. The additives were tested for effectiveness in a motor oil formulation and compared to identical formulations with and without any zinc dialkyldithiophosphate.

Anti-Wear Cameron-Plint Te77 High Frequency Friction Machine Testing

The anti-wear properties of the additives of this invention in a fully formulated lubricating oil were determined in the Cameron-Plint TE77 High Frequency Friction Machine Test. The specimen parts (6 mm diameter AISI 52100 steel ball of 800±20 kg/mm$^2$ hardness and hardened ground NSOH B01 gauge plate of RC 60/0.4 micron) were rinsed and then sonicated for 15 minutes with technical grade hexanes. This procedure was repeated with isopropyl alcohol. The specimens were dried with nitrogen and set into the TE77. The oil bath was filled with 10 mL of sample. The test was run at a 30 Hertz frequency, 100 Newton load, 2.35 mm amplitude. The test starts with the specimens and oil at room temperature. Immediately, the temperature %% as ramped over 15 minutes to 50° C., where it dwelled for 15 minutes. The temperature was then ramped over 15 minutes to 100° C., where it dwelled at 100° C. for 45 minutes. A third temperature ramp over 15 minutes to 150° C. was followed by a final dwell at 150° C. for 15 minutes. The total length of the test was 2 hours. At the end of test, the wear scar diameter on the 6 mm ball was measured using a Leica StereoZoom6® Stereomicroscope and a Mitutoyo 164 series Digimatic Head. The fully formulated lubricating oils tested contained 1 weight % cumene hydroperoxide to help simulate the environment within a running engine. The additives were tested for effectiveness in motor oil formulations and compared to identical formulations with and without any zinc dialkyldithiophosphate. In TABLE 2 the numerical value of the test results (Wear Scar Diameter, m) decreases with an increase in effectiveness. Also determined was the maximum depth of the wear scar on the plate (Wear Scar Depth, $\mu$m). This is measured using a profilimeter. The number in parentheses (#x) is the number of repeat experiments used for the average value.

Examples A–S

The following examples demonstrate the efficacy of the silanes as lubricant additives. They also show a synergistic effect with zinc dialkyldithiophosphate. In addition, they show no harm in corrosion testing.

TABLE 2

Summary of Anti-wear testing of silanes alone and in combination with ZDDP on an equal weight basis - Average results

| Example | Chemical Name | Falex 4-Ball Avg. Wear Scar Diameter (mm) | Cameron-Plint Avg. Ball Wear Scar (mm) | Cameron-Plint Plate Wear Scar, maximum depth ($\mu$m) |
|---|---|---|---|---|
| A (comparative) | ZDDP (1%) | 0.454 (11×) | 0.437 (18×) | 2.33 (18×) |
| B (comparative) | ZDDP (0.5%) | 0.475 (4×) | 0.594 (5×) | 11.32 (5×) |
| C (comparative) | No Anti-wear | 0.800 (10×) | 0.743 (22×) | 17.54 (22×) |
| Single AW (1 wt %) | | | | |
| D (invention) | (Octyl triethoxy Silane) | 0.643 (3×) | 0.684 (2×) | 17.21 (2×) |
| E (invention) | 1,2-bis-(triethoxysilyl) ethane | 0.494 (2×) | 0.589 (2×) | 10.5 (2×) |
| F (invention) | bis(3-triethoxysilyl-1-propyl)tetrasulfide | 0.565 (2×) | 0.706 (2×) | 6.81 (2×) |
| G (invention) | bis(3-triethoxysilyl-1-propyl)disulfide | 0.517 (2×) | 0.659 (5×) | 10.64 (5×) |
| H (invention) | 1,6-Di-(triethoxysilyl) hexane | 0.503 (2×) | 0.462 (2×) | 1.33 (2×) |
| I (invention) | Oligomer of mercaptopropyltriethoxysilane and octyl triethoxysilane prepared by hydrolysis and condensation | 0.478 (2×) | 0.483 (2×) | 1.63 (2×) |
| J (invention) | 1,2,4-tris-(trimethoxysilyl-ethyl)cyclohexane | 0.494 (2×) | 0.488 (2×) | 1.62 (2×) |
| K (comparative) | Butyl Sulfide | 0.524 (3×) | 0.687 (2×) | 19.89 (2×) |
| L (comparative) | Butyl Disulfide | 0.834 (3×) | 0.762 (2×) | 22.54 (2×) |
| Mixtures (0.5 wt % Silane & 0.5 wt % ZDDP) | | | | |
| M (invention) | Octyl triethoxy silane & ZDDP | 0.412 (2×) | 0.456 (2×) | 3.35 (2×) |
| N (invention) | 1,2-bis-(triethoxysilyl) ethane & ZDDP | 0.431 (3×) | 0.385 (2×) | 1.28 (2×) |

TABLE 2-continued

Summary of Anti-wear testing of silanes alone and in combination with ZDDP on an equal weight basis - Average results

| Example | Chemical Name | Falex 4-Ball Avg. Wear Scar Diameter (mm) | Cameron-Plint Avg. Ball Wear Scar (mm) | Cameron-Plint Plate Wear Scar, maximum depth (μm) |
|---|---|---|---|---|
| O (invention) | bis(3-triethoxysilyl-1-propyl)tetrasulfide & ZDDP | 0.445 (4×) | 0.387 (2×) | 1.56 (2×) |
| P (invention) | bis(3-triethoxysilyl-1-propyl)disulfide & ZDDP | 0.455 (2×) | 0.484 (2×) | 3.01 (2×) |
| Q (invention) | 1,6-Di-(triethoxysilyl) hexane & ZDDP | 0.433 (2×) | 0.389 (2×) | 0.909 (2×) |
| R (comparative) | Butyl Sulfide & ZDDP | 0.436 (3×) | 0.644 (2×) | 12.07 (2×) |
| S (comparative) | Butyl Disulfide & ZDDP | 0.471 (4×) | 0.714 (2×) | 14.25 (2×) |

Examples T–X

Pb & Cu Corrosion Testing

In TABLE 3 are the results of a Cummins bench test for measuring the degree of Cu and Pb corrosion of an oil formulation. The Cummins bench test is part of the API CH-4 category for diesel engine oils. Four metal coupons (25.4 mm squares) of pure lead, copper, tin, and phosphor-bronze are immersed in 100 mL of oil at 121° C. with air bubbling through (5 L/hr) for 168 hours. The used oil is analyzed for metals and the copper sample is examined for discoloration. The limits for API CH-4 are 20 ppm Cu, 120 ppm Pb, 50 ppm Sn in used oil and 3 max for the ASTM D 130 rating of the copper square. Additives were blended into a fully formulated SAE 5W-30 oil with ILSAC GF-2 credentials. In the first two rows of Table 3 are data generated on the SAE 5W-30 oil without any top treat of other additives. All the silanes did very well on Pb corrosion with passing results.

TABLE 3

ASTM D 5968 Corrosion Bench Test of Engine Oil at 121° C.

| Example | Additive | Additive Wt. % | Cu ppm | Pb ppm | ASTM D 130 |
|---|---|---|---|---|---|
| T (comparative) | SAE 5W-30 oil w/o top treat | 0 | 8 | 33.7 | 1b |
| U (comparative) | SAE 5W-30 oil w/o top treat | 0 | 7 | 41.1 | 1b |
| V (invention) | bis(3-triethoxysilyl-1-propyl)tetrasulfide | 1 | 45 | 21.4 | 4a |
| W (invention) | bis(3-triethoxysilyl-1-propyl)disulfide | 1 | 7.5 | 32.0 | 1b |
| X (invention) | 1,2-bis-(triethoxysilyl) ethane | 1 | 8.0 | 51.2 | 1b |

In view of the many changes and modifications that can be made without departing from principles underlying the invention, reference should be made to the appended claims for an understanding of the scope of the protection to be afforded the invention.

What is claimed is:

1. A composition comprising:

(A) a lubricant, and (B) at least one silane of the formula (I):

$$[(R^1)_{3-a}\ (R^2O)_a\ Si]_rA \quad (I)$$

wherein $R^1$ is selected from the group consisting of saturated and unsaturated hydrocarbyl and saturated and unsaturated chain-substituted hydrocarbyl;

$R^2$ is selected from the group consisting of hydrogen, saturated and unsaturated hydrocarbyl and saturated and unsaturated chain-substituted hydrocarbyl;

a is an integer from 1 to 3; and

A is a group of valence r, r being an integer greater than or equal to 1, selected from the group consisting of linear, branched, or cyclic hydrocarbyl groups, an oxygen atom, or a linear, branched, or cyclic siloxane or polysiloxane group, each of which, except for an oxygen atom, optionally comprises substituents having oxygen, nitrogen, sulfur, or halogen heteroatoms;

provided that if r is equal to 1, A is a linear or branched hydrocarbyl radical of from 1 to 24 carbon atoms.

2. A composition comprising:

(A) a lubricant, and (B) at least one silane of the formula (II):

$$(R^1{}_{3-a})(R^2O)_a—Si—B—Si—(OR^2)_a(R^1{}_{3-a}) \quad (II)$$

wherein $R^1$ is selected from the group consisting of saturated and unsaturated hydrocarbyl and saturated and unsaturated chain-substituted hydrocarbyl;

$R^2$ is selected from the group consisting of hydrogen, saturated and unsaturated hydrocarbyl and saturated and unsaturated chain-substituted hydrocarbyl;

a is an integer from 1 to 3; and

B is a divalent group selected from the group consisting of a saturated or unsaturated linear, branched, or cyclic hydrocarbyl group, an oxygen atom, a linear, branched, or cyclic siloxane or polysiloxane group, each of which, except for an oxygen atom, optionally comprises substituents having oxygen, nitrogen, sulfur, halogen heteroatoms, $(CR^4R^5)_b(CR^6R^7)_c$, $C_bH_{2b}$—X'—$C_cH_{2c}$, $(CR^4R^5)_p$—X'—$(CR^6R^7)_q$, and cyclo $C_sH_q(C_bH_{2b}b)_t$, wherein $R^4$, $R^5$, $R^6$, and $R^7$ are the same or different and are independently selected from the group consisting of hydrogen, saturated and unsaturated hydrocarbyl, and saturated and unsaturated chain-substituted hydrocarbyl, b, c, p, and q are integers independently selected from 1 to 18, s in an integer greater than 2, t is an integer greater than 1, and X' is selected from the group consisting of

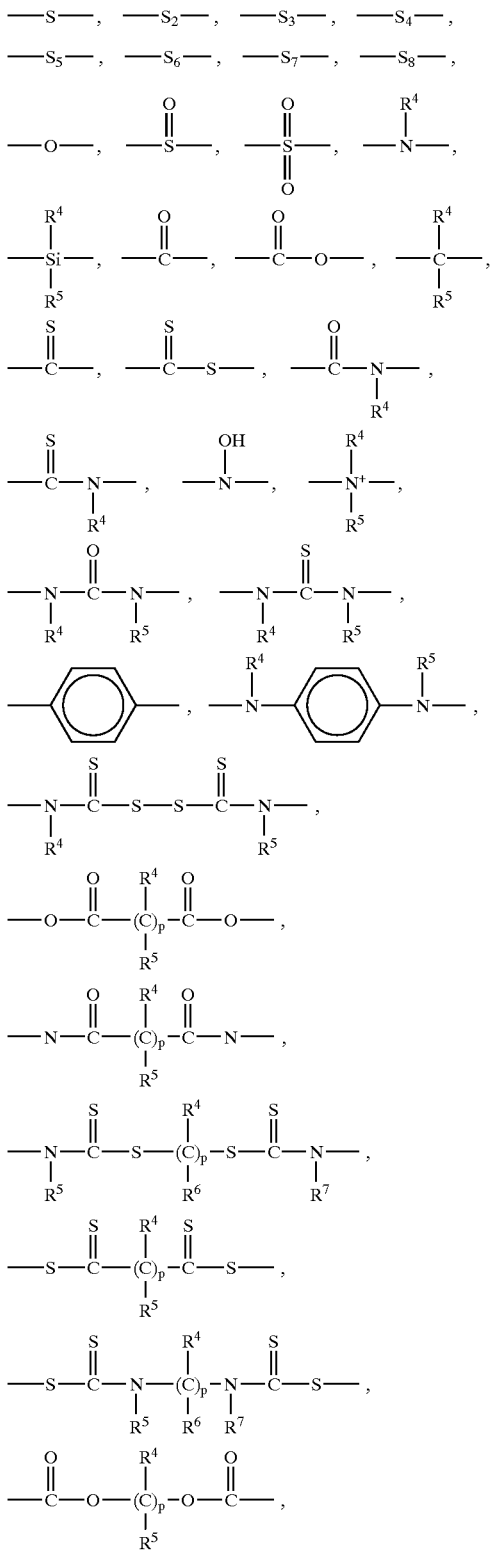

-continued

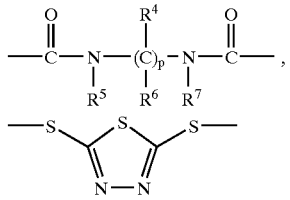

and mixtures thereof, wherein $R^4$, $R^5$, $R^6$ and $R^7$ are independently the same or different and are as defined above.

3. The composition of claim 1 further comprising at least one additional additive selected from the group consisting of dispersants, detergents, rust inhibitors, antioxidants, metal deactivators, anti-wear agents, extreme pressure agents, antifoamants, friction modifiers, seal swell agents, demulsifiers, Viscosity Index improvers, and pour point depressants.

4. The composition of claim 1 further comprising at least one additional additive selected from the group consisting of zinc dialkyldithiophosphate, zinc diaryldithiophosphate, and zinc alkylaryldithiophosphate.

5. The composition of claim 1 wherein the lubricant is a lubricating oil.

6. The composition of claim 2 wherein the lubricant is a lubricating oil.

7. A composition comprising:

(A) a lubricant or hydrocarbon fuel, and (B) at least one silane selected from the group consisting of bis(3-triethoxysilyl-1-propyll) tetrasulfide; bis(3-triethoxysilyl-1-propyl) disulfide; 1,2-bis-(triethoxysilyl) ethane; 1,4-bis-(triethoxysilyl) butane; 1,6-bis-(triethoxysilyl) hexane; octyl triethoxy silane, and 1,2,4-tris-(2-trimethoxysilylethyl)cyclohexane.

8. A composition comprising:

(A) a lubricant or hydrocarbon fuel, (B) at least one silane of the formula (II):

$$(R^1_{3-a})(R^2O)_a\text{—Si—B—Si—}(OR^2)_a(R^1_{3-a}) \qquad \text{(II)}$$

wherein $R^1$ is selected from the group consisting of saturated and unsaturated hydrocarbyl and saturated and unsaturated chain-substituted hydrocarbyl;

$R^2$ is selected from the group consisting of hydrogen, saturated and unsaturated hydrocarbyl and saturated and unsaturated chain-substituted hydrocarbyl;

a is an integer from 1 to 3; and

B is a divalent group selected from the group consisting of a saturated or unsaturated linear, branched, or cyclic hydrocarbyl group, an oxygen atom, a linear, branched, or cyclic siloxane or polysiloxane group, each of which, except for an oxygen atom, optionally comprises substituents having oxygen, nitrogen, sulfur, halogen heteroatoms, $(CR^4R^5)_b(CR^6R^7)_c$, $C_bH_{2b}$—X'—$C_cH_{2c}$, $(CR^4R^5)_p$—X'—$(CR^6R^7)_q$, and cyclo $C_8H_q(C_bH_{2b})_t$, wherein $R^4$, $R^5$, $R^6$, and $R^7$ are the same or different and are independently selected from the group consisting of hydrogen, saturated and unsaturated hydrocarbyl, and saturated and unsaturated chain-substituted hydrocarbyl, b, c, p, and q are integers independently selected from 1 to 18, s in an integer greater than 2, t is an integer greater than 1, and X' is selected from the group consisting of

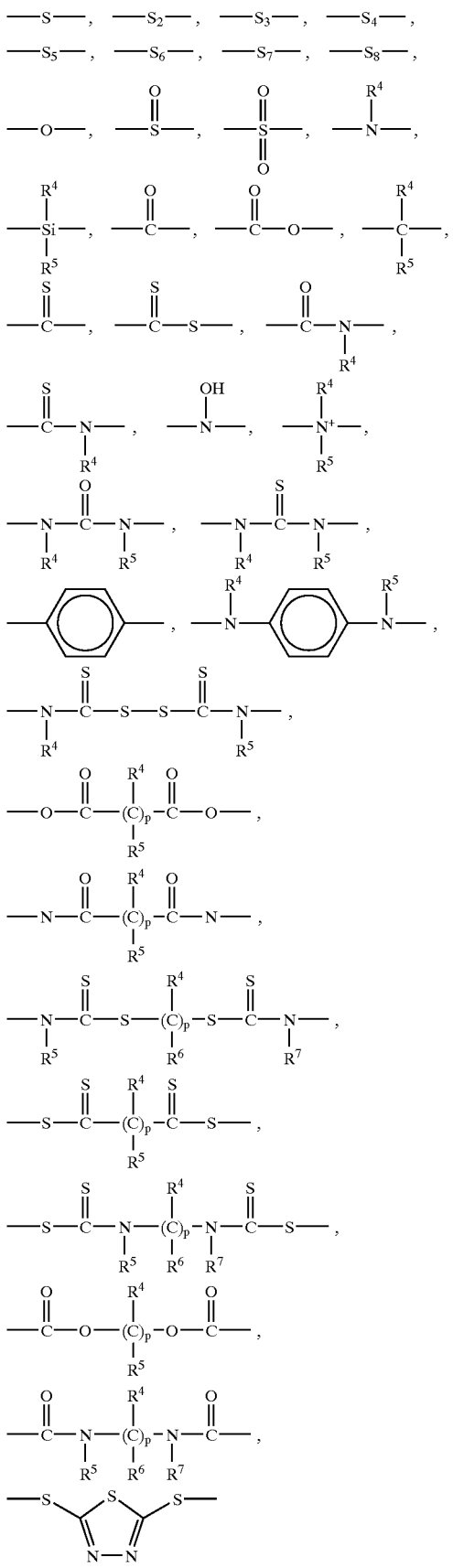

and mixtures thereof, wherein $R^4$, $R^5$, $R^6$ and $R^7$ are independently the same or different and are as defined above, and (C) at least one additive selected from the group consisting of dispersants, detergents, rust inhibitors, antioxidants, metal deactivators, anti-wear agents, extreme pressure agents, antifoamants, friction modifiers, seal swell agents, demulsifiers, Viscosity Index improvers, and pour point depressants.

9. A composition comprising:

(A) a lubricant or hydrocarbon fuel;

(B) at least one silane of the formula (II):

$$(R^1{}_{3-a})(R^2O)_a\text{—Si—B—Si—}(OR^2)_a(R^1{}_{3-a}) \qquad \text{(II)}$$

wherein $R^1$ is selected from the group consisting of saturated and unsaturated hydrocarbyl and saturated and unsaturated chain-substituted hydrocarbyl;

$R^2$ is selected from the group consisting of hydrogen, saturated and unsaturated hydrocarbyl and saturated and unsaturated chain-substituted hydrocarbyl;

a is an integer from 1 to 3; and

B is a divalent group selected from the group consisting of a saturated or unsaturated linear, branched, or cyclic hydrocarbyl group, an oxygen atom, a linear, branched, or cyclic siloxane or polysiloxane group, each of which, except for an oxygen atom, optionally comprises substituents having oxygen, nitrogen, sulfur, halogen heteroatoms, $(CR^4R^5)_b(CR^6R^7)_c$, $C_bH_{2b}$—X'—$C_cH_{2c}$, $(CR^4R^5)_p$—X'—$(CR^6R^7)_q$, and cyclo $C_sH_q(C_bH_{2b})_t$, wherein $R^4$, $R^5$, $R^6$, and $R^7$ are the same or different and are independently selected from the group consisting of hydrogen, saturated and unsaturated hydrocarbyl, and saturated and unsaturated chain-substituted hydrocarbyl, b, c, p, and q are integers independently selected from 1 to 18, s in an integer greater than 2, t is an integer greater than 1, and X' is selected from the group consisting of

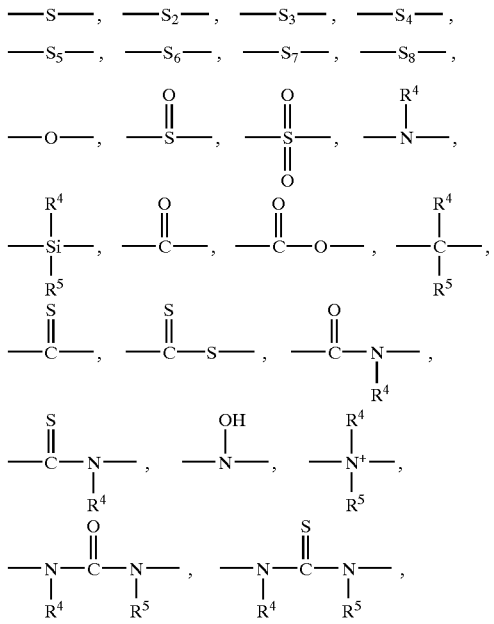

-continued
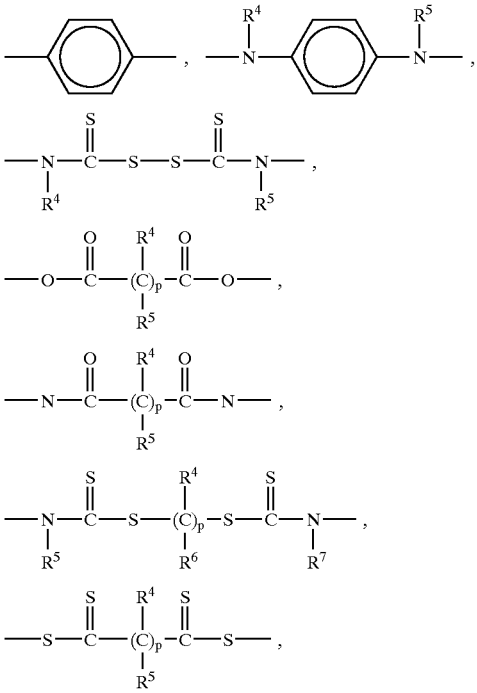
-continued
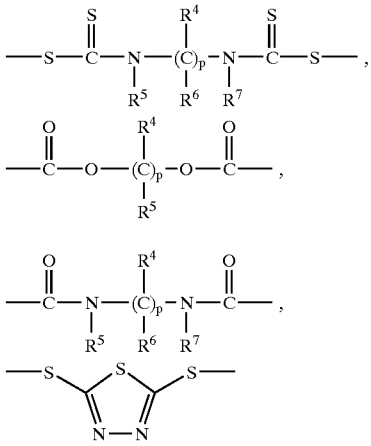
and mixtures thereof, wherein $R^4$, $R^5$, $R^6$ and $R^7$ are independently the same or different and are as defined above; and
(C) at least one additive selected from the group consisting of zinc dialkyldithiophosphate, zinc diaryldithiophosphate, and zinc alkylaryldithiophosphate.
* * * * *